United States Patent [19]

Isola

[11] 4,204,353

[45] May 27, 1980

[54] FIREARM CARTRIDGE RECEIVER

[76] Inventor: Raymond O. Isola, 1071 Killmaster Dr., Oscoda, Mich. 48750

[21] Appl. No.: 895,097

[22] Filed: Apr. 10, 1978

[51] Int. Cl.[2] ..... F41C 27/00

[52] U.S. Cl. ..... 42/1 T

[58] Field of Search ..... 42/1 T; 89/33 F

[56] References Cited

FOREIGN PATENT DOCUMENTS 563739 8/1944 United Kingdom ..... 89/33 F 1336696 11/1973 United Kingdom ..... 42/1 T

*Primary Examiner*—Stephen C. Bentley

*Attorney, Agent, or Firm*—Robert L. McKellar

[57] ABSTRACT

What is disclosed is an improved device for retrieving cartridges and cases ejected from a firearm. The device is fashioned so as to allow easy mounting, removal and storage of the device. The device is also equipped with a cartridge alignment mechanism to prevent jamming of the firearm by ejected cartridges.

2 Claims, 6 Drawing Figures

FIREARM CARTRIDGE RECEIVER

BACKGROUND OF THE INVENTION

This invention relates to a retriever for cartridges or spent casings that are ejected from a firearm. Many shotguns and rifles in use in the world today are the type that loud and eject from a side port as opposed to a top port. For various odd reasons, persons who use such weapons are disposed to collect the casings that are ejected upon firing the weapon or as a practical matter are interested in collecting unfired cartridges or shells so as to prevent them from falling to the ground and becoming dirty or damaged.

Many devices have been developed for retrieving cartridges, casings and shells since one of the major costs in reloading the same is the cost of the casing itself. Generally, upon firing a firearm and ejection of the spent cartridge therefrom, the cartridge usually is flung some distance from the person operating the firearm and thus the cartridge can be damaged or even lost so that it cannot be re-used. Moreover, if one wishes to remove live cartridges or shells from a firearm at the end of a hunt or target practice, they must be carefully removed and collected in order to ensure that they are not damaged or that they do not carry dirt and debris back into the firearm when the firearm is reloaded.

Thus, it is not surprising that several devices have been designed to retrieve cartridges.

Aside from the significance of collecting cartridges, such collecting devices should have other desirable features, such as, easy and simple mounting on the firearm and easy removal for storage. They should also be lightweight and non-bulky and should not interfere with the operation of the firearm. They must also accomodate several cartridges at one time but not be so large that they unbalance the firearm or obscure vision of the person firing the weapon.

E. E. Richardson in U.S. Pat. No. 2,354,277 shows a retriever for firearm ejected shells which consists of a box-like receiver having mounting means. The box-like receiver is rigid and the ejected shells are carried some distance away from the firearm down the box-like receiver. This retriever is not easily storable, such as in the clothes pocket of the operator, and has no energy absorbing means for the ejected cartridge.

Another version of a retriever device is that shown by G. M. Pruonto et al., U.S. Pat. No. 3,618,458, which is a metal box-like device that attaches to the firearm by the use of a permanent mounting bracket and screws. Ready removal and storage of this device is not contemplated by the inventors therein.

A third device of the prior art is a lobe-shaped receptacle shown in U.S. Pat. No. 3,739,685. This device is mounted on the side of the firearm by a top mounting clip and a bottom mounting stud and a screw. Easy removal of the device is not encouraged by the use of the screw which would involve the use of a tool of some sort. Moreover, the device does not have any energy absorbing mechanism nor any alignment mechanism for the ejected cartridges.

U.S. Pat. No. 3,153,981 describes a lightweight, easy mountable device for retrieving cartridges. It consists of a flexible bag for receiving the ejected cartridges and a mounting means which is not permanently affixed and which involves the use of suction cups on a U-shaped spring clamp. The device, however, does not have an energy absorbing means nor a cartridge alignment means. The cartridges are free to sort out their own alignment after ejection.

Finally, Dobson, in U.S. Pat. No. 4,028,834, shows a cartridge retriever which has a removable wire mesh basket for collecting the cartridges and which has a mounting means consisting of a spring bias clamping device or a clamping device which surrounds the firearm.

The device is designed so that the basket is removable or the entire apparatus can be removed from the firearm. The device also has an energy absorbing mechanism in that the housing is made from a deformable plastic or rubber. The device however does not have any alignment mechanism nor is the wire basket collapsible so that it can be readily stored. The wire basket is also susceptible to bending and denting which eventually would not allow proper alignment of the basket on the mounting apparatus.

Thus, the instant invention device is designed to overcome the disadvantages and shortcomings of the prior art.

SUMMARY OF THE INVENTION

Accordingly, it is the object of this invention to provide a device which can be conveniently attached to a firearm for retrieving cartridges and which can be easily removed and stored in one's pocket.

It is a further object of this invention to provide a cartridge retriever which has an energy absorbing means and a cartridge alignment means.

It is still a further object of this invention to provide a one-piece cartridge retriever.

It is yet another object of this invention to provide a light-weight cartridge retriever.

These objects are accomplished by the present invention by providing a retriever housing made of a rigid material which housing has an opening along one lateral surface. The opening is designed to be mounted adjacent the lateral surface of a firearm and covering the cartridge ejection port thereof. There is a bottom opening in the housing and attached around the circumference of the opening is a flexible, folding pocket which when fully unfolded will hold several cartridges. The pocket is designed so as to have three walls projecting downwardly from the bottom opening and a fourth wall which slopes downwardly and away from the lateral opening of the housing. The sloping wall and the bottom of the pocket both contain a rigid panel on one of their surfaces. For purposes of this invention, the bottom rigid panel is preferably mounted inside the pocket; the sloping wall rigid panel is preferably mounted on the outside of the pocket wall. These rigid panels serve to align the cartridge upon its ejection from the firearm so that it does not sit crosswise of the pocket and jam incoming cartridges.

The top, sides and partial bottom of the housing are made from a rigid material such as metal or plastic. The inside of the wall of the housing opposite the lateral opening is covered with a resilient, energy absorbing material such as flexible foam. The edge of the lateral opening of the housing may be fitted with a soft lining so as to prevent injury to the surface of the firearm.

The top of the housing is fitted with a mounting and locking means by which the device is attached to the firearm and securely locked in place. The locking means is comprised of a projecting lug which is a partial extension of the top of the housing and which fits into a slot which is part of a mounting means which fits on the upper surface of the firearm and which will be discussed further infra. The housing also has a slotted aperture in its upper surface and directly behind the projecting lug. The surface of the housing has surmounted on its edge closest to the lateral opening a slotted aperture which receives a second projecting lug which is part of the mounting on the upper surface of the firearm. Finally, mounted on the underside of the top of the housing is a metallic spring fastened at its end distal to the lateral opening with a fastening means. The spring is actuated by pressure on a button mounted on the upper surface of the spring and projecting through an opening in the housing top. The spring has mounted on its upper surface at the end closest to the lateral opening a lip which when the device is mounted on the firearm, slips into a slot on the mounting on the firearm and rigidly holds the device on the firearm. The ends of the sides of the housing are concave on their leading edges so that the device fits snugly against the side of the firearm. In use, the button on the spring is depressed whereupon the lip on the spring disengages from the slot on the firearm and the device is disconnected from the firearm in one easy motion.

DESCRIPTION OF THE SPECIFIC EMBODIMENTS

The following description is not to be construed to limit the invention over that which is fairly taught in the claims.

Figure 2:
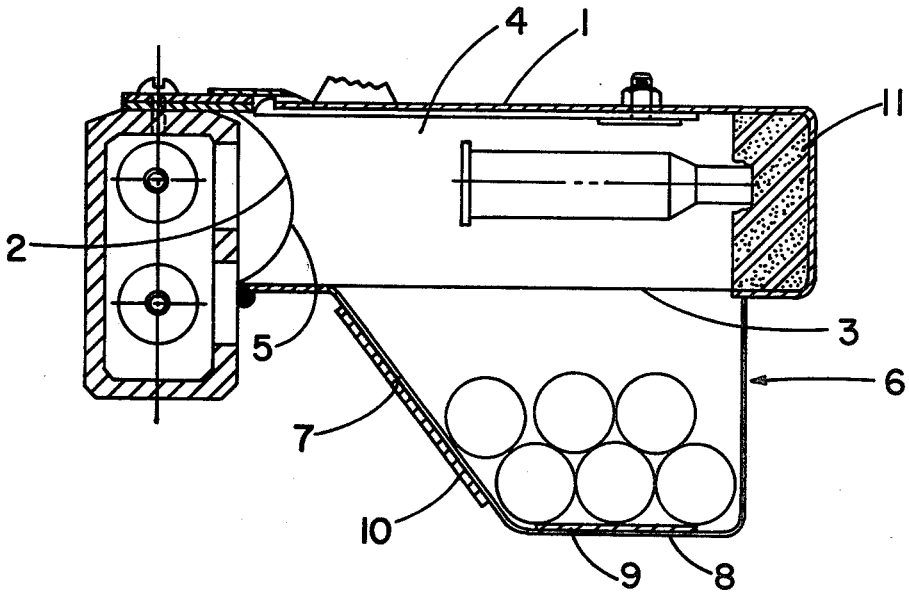
FIG. 2 is a cross-section through line AA of FIG. 1 of a firearm and the device shown through the centerline of the firearm shell ejector port.

As shown in FIG. 2, the device consists of a rigid housing 1 made of a rigid material such as metal or strong, inflexible plastic. The housing is constructed with an opening along one lateral surface as indicated by the numeral 2 and a second opening which is on the bottom 3. The opening 2 is designed to cover the cartridge ejection port of the firearm it is mounted on. The sides 4 of the rigid housing are designed with concave leading edges as illustrated at 5 so that the device fits snugly against the side of the firearm (the arc is exaggerated for illustration purposes).

Around the circumference of the bottom opening 3, there is attached a flexible, folding pocket 6 which when fully unfolded will hold several cartridges or empty shells. The pocket 6 is designed so as to have three vertical walls projecting downwardly from the bottom opening and a fourth wall 7 which slopes downwardly and away from the lateral opening of the housing. The sloping wall 7 and the bottom of the pocket 8 both contain a rigid panel on one of their surfaces. The rigid panel is slightly smaller in area than the surfaces which they are mounted on in order to make the panel foldable within the flexible pocket. For purposes of this invention, the bottom rigid panel 9 is preferably mounted inside of the pocket; the sloping wall rigid panel 10 is preferably mounted on the outside of the pocket wall. The rigid panels serve as striker plates for the ejected cartridge and thus cause the cartridge to fall free from the side wall thus preventing jamming of the cartridges.

The inside wall of the rigid housing opposite the lateral opening is covered with a resilient energy absorbing material 11, such as flexible polyurethane foam.

Figure 1:
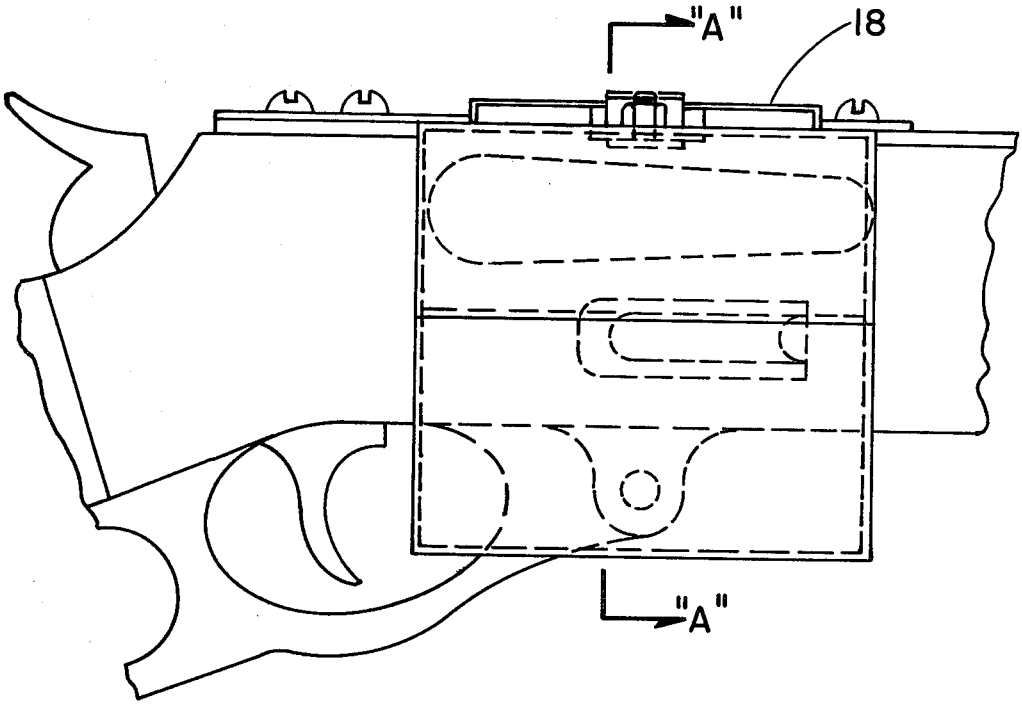
FIG. 1 is a plan view of the device mounted on a firearm.
Figures 3, 4:
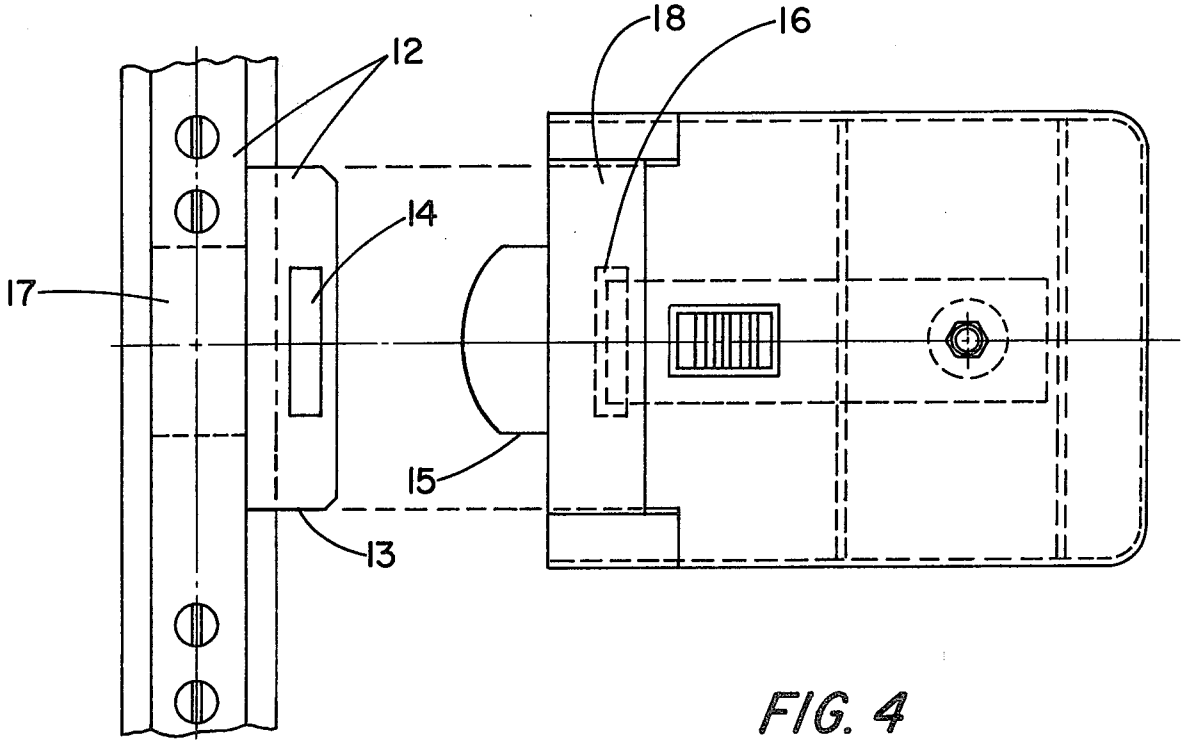
FIGS. 3 and 4 is a plan view of the firearm with mounting lug and the cartridge retriever indicating how the device is mounted on the firearm.

As shown in FIGS. 3 and 4, the top of the firearm and the rigid housing are fitted with a mounting and locking means. The firearm has mounted on its upper surface a mounting bar 12. The mounting bar has a projecting lug 13 with a slotted aperture 14. The rigid housing has a projecting lug 15 and a slotted aperture 16. The projecting lug 15 is an extension of the top of the rigid housing and fits underneath lug 13 and into a slot 17 when the device is fitted to the firearm. A raised portion 18 (see also FIGS. 1 and 6), mounted on the rigid housing, accepts and guides the lug 13 into place.

Figure 5:
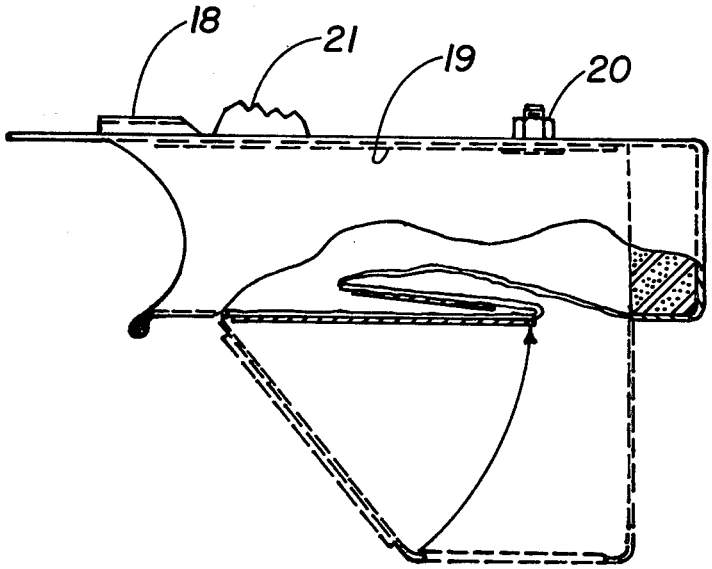
FIG. 5 is a side elevation of the cartridge retriever and illustrates how the bottom flexible section or pocket is folded into the retriever housing when the device is not in use.
Figure 6:
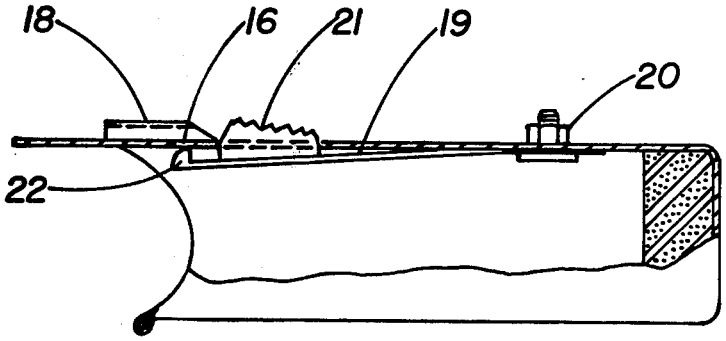
FIG. 6 is a partial view showing the locking spring position, when pressed into release position, to mount or disengage the device from the firearm.

Mounted on the underside of the top of the housing is a spring 19 as shown in FIGS. 5 and 6. The spring is fastened to the housing by a suitable fastener 20. The spring is actuated by pressure on a rigid button 21. The spring has seated on its upper surface, distal to the fastened end, a lip 22 which passes up through the slot 16 of the housing and on up through a similar slot in the lug 13 when that lug is in place.

For removal from the firearm, the button is depressed and the device pulled away from the firearm. The device then can be up-ended to remove the collected cartridges or the device, cartridges intact, can be stored away.

Obviously, some modifications and variations to the above disclosure can be made without departing from the spirit of the invention.

That which is claimed is:

1. In an improved firearm cartridge retriever for retrieving cartridges and cases ejected from a firearm comprising a rigid housing adapted to be mounted on a firearm and having an opening in register with a cartridge ejection port of said firearm, a mounting device for mounting the cartridge retriever, a locking device for maintaining the retriever on the firearm, and a pocket for holding ejected cartridges, said pocket being completely foldable into the housing, the improvements which comprise:

an energy absorbing pad of resilient material mounted inside the housing above said pocket and opposite said opening, a cartridge alignment panel mounted on a portion of the pocket opposite and below the energy absorbing pad and holding that portion of the pocket rigidly in a downward direction sloping away from said opening when the pocket is in its unfolded condition, whereby cartridges or cases bouncing from said pad are forced into alignment by the sloping pocket portion, and a rigid bottom panel mounted on the bottom portion of said pocket to additionally assist in alignment of cartridges or cases in said pocket.

2. An improved retriever as claimed in claim 1 wherein the improvement further comprises the locking device for maintaining the cartridge retriever on the firearm which is a spring activated locking device having a projecting lip affixed thereto for engagement with a slot provided in a mounting lug affixed to the firearm, said locking device having a manually depressable button for urging the spring and its lip out of engagement with the slot.

* * * * *